US011065477B2

(12) United States Patent
Ratalino

(10) Patent No.: US 11,065,477 B2
(45) Date of Patent: Jul. 20, 2021

(54) FALL-PROTECTION APPARATUS WITH BRAKING SYSTEM

(71) Applicant: 3M INNOVATIVE PROPERTIES COMPANY, St. Paul, MN (US)

(72) Inventor: Oscar Ratalino, Kings Park (AU)

(73) Assignee: 3M Innovative Properties Company, St. Paul, MN (US)

( * ) Notice: Subject to any disclaimer, the term of this patent is extended or adjusted under 35 U.S.C. 154(b) by 298 days.

(21) Appl. No.: 16/468,593

(22) PCT Filed: Dec. 7, 2017

(86) PCT No.: PCT/US2017/065063

§ 371 (c)(1),
(2) Date: Jun. 11, 2019

(87) PCT Pub. No.: WO2018/111676

PCT Pub. Date: Jun. 21, 2018

(65) Prior Publication Data

US 2019/0351264 A1 Nov. 21, 2019

Related U.S. Application Data

(60) Provisional application No. 62/435,202, filed on Dec. 16, 2016.

(51) Int. Cl.
*A62B 1/14* (2006.01)

(52) U.S. Cl.
CPC ..... *A62B 1/14* (2013.01)

(58) Field of Classification Search
CPC .... A62B 1/00; A62B 1/06; A62B 1/08; A62B 1/10; A62B 1/14
See application file for complete search history.

(56) References Cited

U.S. PATENT DOCUMENTS

| | | | | |
|---|---|---|---|---|
| 4,596,314 A | | 6/1986 | Rogelja | |
| 5,054,577 A | | 10/1991 | Petzl | |
| 5,076,400 A | | 12/1991 | Petzl | |
| 5,360,083 A | * | 11/1994 | Hede | A62B 1/14 182/5 |
| 5,577,576 A | * | 11/1996 | Petzl | A62B 1/14 188/65.4 |

(Continued)

FOREIGN PATENT DOCUMENTS

| | | |
|---|---|---|
| AU | 562682 | 6/1987 |
| AU | 622996 | 4/1992 |

(Continued)

OTHER PUBLICATIONS

International Search Report for PCT International Application No. PCT/US2017/065063, dated Feb. 27, 2018, 4 pages.

*Primary Examiner* — Alvin C Chin-Shue
*Assistant Examiner* — Shiref M Mekhaeil
(74) *Attorney, Agent, or Firm* — Kenneth B. Wood

(57) ABSTRACT

A fall-protection apparatus with a friction-braking system comprising a handle that is disconnectably connected to a braking cam so that when the handle is moved from a braking position to a non-braking position the braking cam is pivotally moved from a braking configuration to a non-braking configuration, and so that when the handle is moved to a disconnecting position the connection between the handle and the braking cam is disconnected.

21 Claims, 10 Drawing Sheets

(56) References Cited

U.S. PATENT DOCUMENTS

| | | | | |
|---|---|---|---|---|
| 6,378,650 | B2 * | 4/2002 | Mauthner | A62B 1/10 182/193 |
| 7,137,481 | B2 | 11/2006 | Petzl | |
| 7,845,467 | B2 | 12/2010 | Petzl | |
| 8,100,231 | B2 | 1/2012 | Petzl | |
| 8,348,016 | B2 * | 1/2013 | Lewis | A62B 1/14 182/192 |
| 8,584,814 | B2 | 11/2013 | Chaumontet | |
| 8,733,504 | B2 * | 5/2014 | Mauthner | A62B 35/04 182/191 |
| 9,415,245 | B2 * | 8/2016 | Codega | A62B 1/14 |
| 9,573,002 | B2 | 2/2017 | Lefebvre | |
| 10,035,028 | B1 * | 7/2018 | Siegel | A62B 1/06 |
| 10,092,781 | B2 * | 10/2018 | Malcolm | A62B 1/14 |
| 10,384,083 | B2 * | 8/2019 | Bell | A62B 1/14 |
| 10,716,960 | B2 * | 7/2020 | Chaumontet | A62B 1/14 |
| 10,881,884 | B1 * | 1/2021 | Siegel | A62B 1/06 |
| 2007/0215411 | A1 * | 9/2007 | Petzl | A62B 1/14 182/193 |
| 2009/0026023 | A1 * | 1/2009 | Petzl | A62B 1/14 188/65.4 |
| 2009/0120720 | A1 * | 5/2009 | Arms | A62B 1/14 182/193 |
| 2011/0073417 | A1 * | 3/2011 | Chaumontet | A62B 1/14 188/65.5 |
| 2011/0186388 | A1 * | 8/2011 | Sudale | A62B 1/14 188/65.2 |
| 2012/0193166 | A1 | 8/2012 | Rogelja | |
| 2012/0261212 | A1 | 10/2012 | Bonaiti | |
| 2013/0032433 | A1 | 2/2013 | Codega | |
| 2014/0311835 | A1 | 10/2014 | De Miguel Valiente | |
| 2015/0096838 | A1 | 4/2015 | Lefebvre | |

FOREIGN PATENT DOCUMENTS

| | | |
|---|---|---|
| AU | 623523 | 5/1992 |
| AU | 682107 | 9/1997 |
| AU | 2010258092 | 12/2011 |
| CA | 1222981 | 6/1987 |
| EP | 0132592 | 2/1985 |
| EP | 0303388 | 2/1989 |
| EP | 0688581 | 12/1995 |
| EP | 2018894 | 1/2009 |
| EP | 2246100 | 11/2010 |
| EP | 2554219 | 2/2013 |
| EP | 2711054 | 3/2014 |
| EP | 2777772 | 9/2014 |
| FR | 2919195 | 1/2009 |
| WO | WO 2010-026201 | 3/2010 |
| WO | WO 2010-141988 | 12/2010 |

* cited by examiner

FALL-PROTECTION APPARATUS WITH BRAKING SYSTEM

BACKGROUND

Fall-protection products such as rope adjusters and descenders have found use in, for example, at-height working (e.g. in building construction, assembly and servicing of electrical transmission towers, power-generating windmills), and in mountaineering and rescue operations.

SUMMARY

In broad summary, herein is disclosed a fall-protection apparatus with a braking system comprising a handle that is disconnectably connected to a braking cam so that when the handle is moved from a braking position to a non-braking position the braking cam is pivotally moved from a braking configuration to a non-braking configuration, and so that when the handle is moved to a disconnecting position the connection between the handle and the braking cam is disconnected. The braking system utilizes an elongate pin and a lobed cam plate. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "first" and "second" may be used in this disclosure, it should be understood that those terms are used in their relative sense only unless otherwise noted. The term "left" is used to refer to the major side of an apparatus that comprises a handle, with the term "right" referring to the opposite major side. This terminology is used purely for convenience of description and does not limit the orientation of the apparatus in ordinary use. Terms such as "top", bottom", "upper", lower", "under", "over", and the like, have their ordinary meaning in relation to the Earth's gravity. Terms such as "forward", "front", "forwardmost", and the like, and "rearward", "rearmost", and the like, are defined in regard to the position of an elongate pin relative to a braking cam of a braking system, with forward referring to a direction toward the braking cam and with rearward referring to a direction away from the braking cam, as discussed in detail later herein. By "pivotally movable" is meant able to be rotated through an arc, about an at least generally transverse axis of the apparatus.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). The term "substantially" means to a high degree of approximation (e.g., within +/−5% for quantifiable properties).

DETAILED DESCRIPTION

Figure 1:
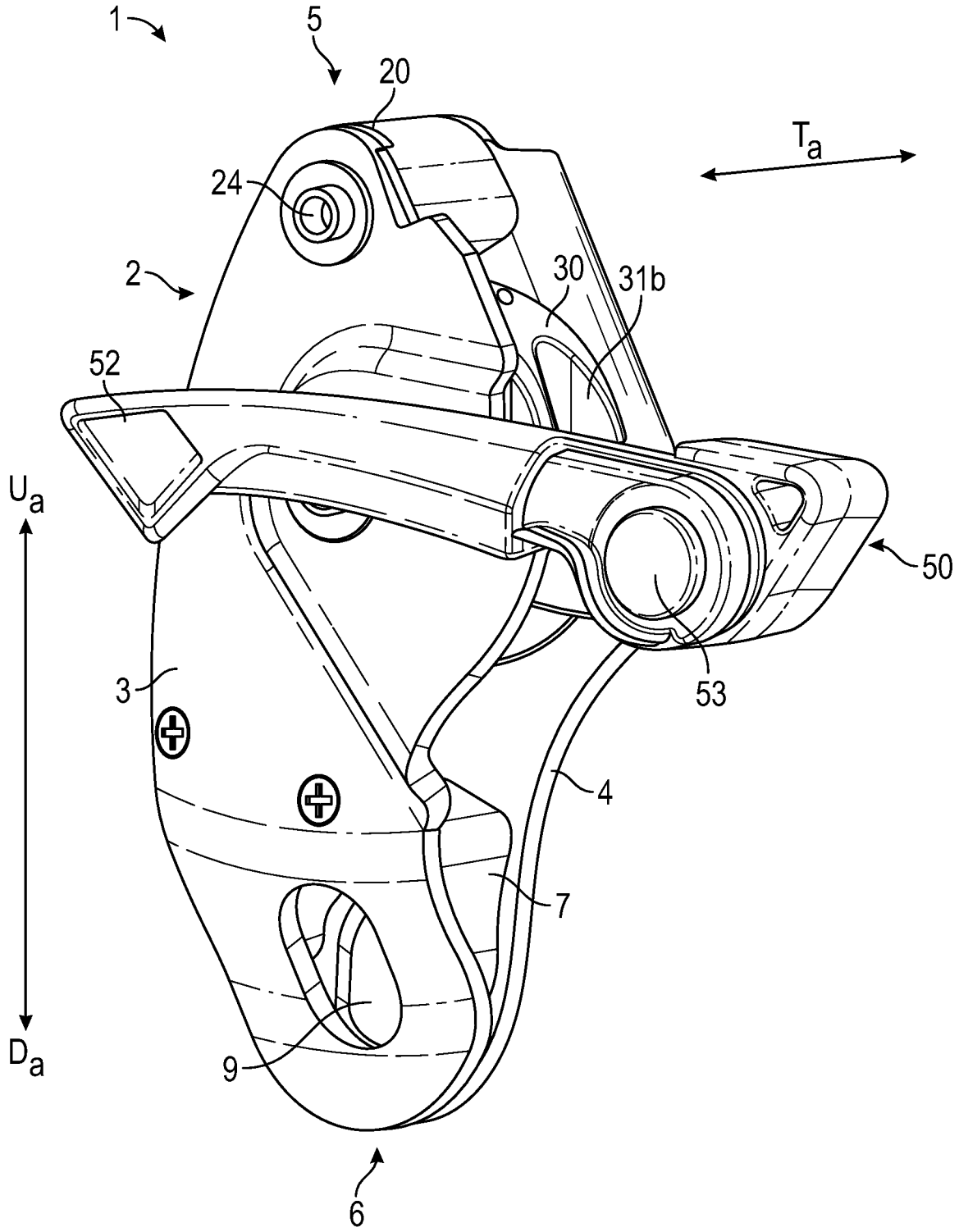
FIG. 1 is a perspective view, from the left side, of an exemplary fall-protection apparatus.
Figure 2:
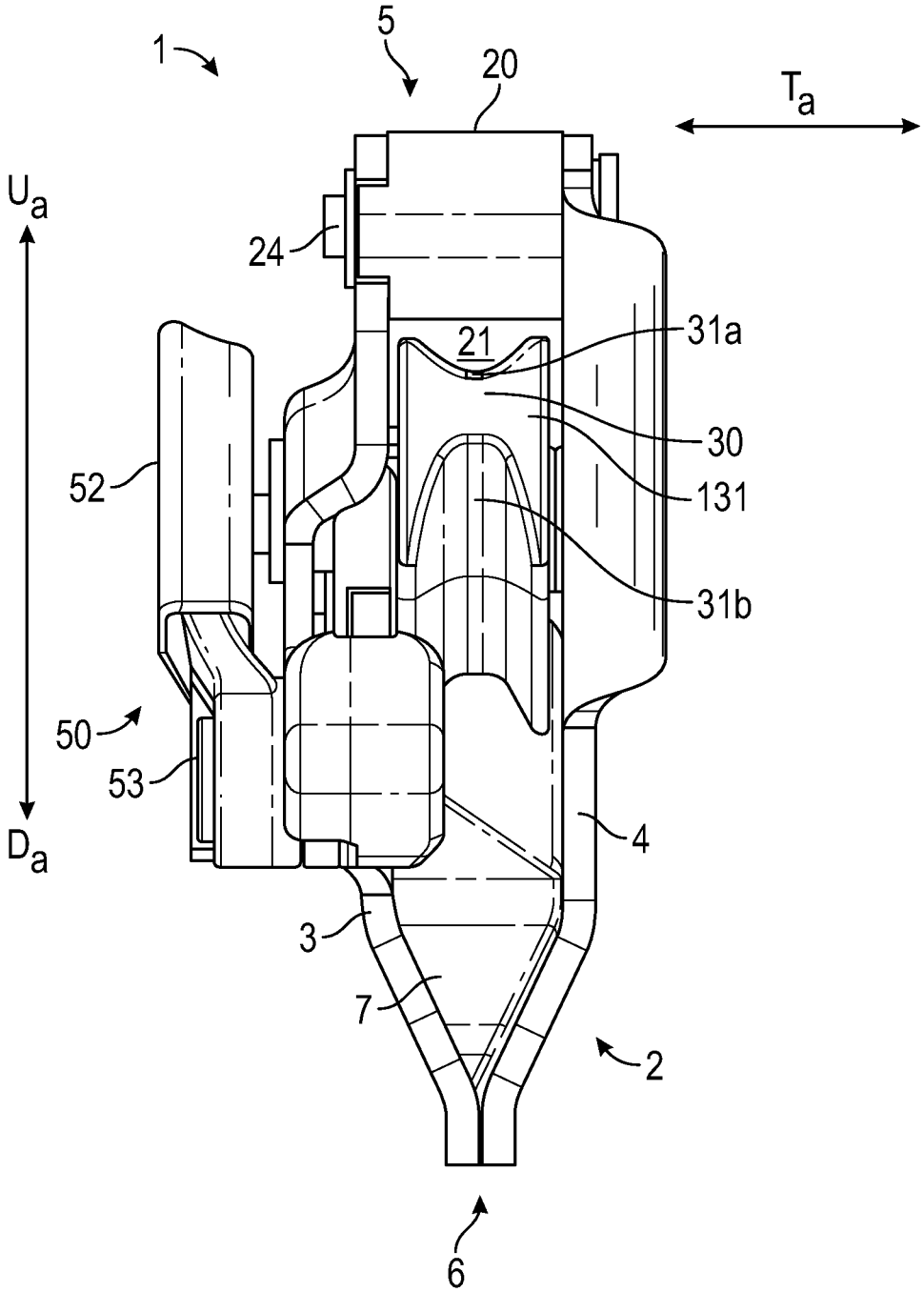
FIG. 2 is a rear perspective view of an exemplary fall-protection apparatus.

Disclosed herein is a fall-protection apparatus 1, as shown in exemplary embodiment (viewed from the left side) in FIG. 1, and as viewed from the rear in FIG. 2. Apparatus 1 comprises a main body 2 that, in the depicted embodiment, is provided by a first side plate 3 and a second side plate 4 (which are respectively referred to as a left side plate and a right side plate with reference to the Figures herein). Side plates 3 and 4 may be held together by any suitably strong and robust mechanical fastener or fasteners (chosen from e.g. rivets, screws, bolts and so on, in any desired combination). Main body 2 may additionally include any other components (e.g. one or more spacer struts 7) as found convenient.

Apparatus 1 is configured to be operated by a user working (e.g. at an elevated height) in the Earth's gravity, and thus comprises an upper end 5 and a lower end 6 and exhibits an upward-downward direction $U_a$-$D_a$ as illustrated in FIG. 1. (Is it noted however than in use of apparatus 1, the orientation of apparatus 1 may occasionally deviate considerably from the exact upward-downward orientation shown in FIG. 1.) Apparatus 1 comprises a transverse (lateral) direction $T_a$ that extends through the shortest dimension (i.e. the "width" dimension) of apparatus 1 and with which certain components (e.g. one or more axles) of apparatus 1 may be at least generally aligned. First and second side plates 3 and 4 define a transverse space therebetween, which space contains components of a friction-braking system as described herein (noting however that at least portions of at least some components (e.g. a handle 50) may protrude out of this transverse space).

Figure 3:
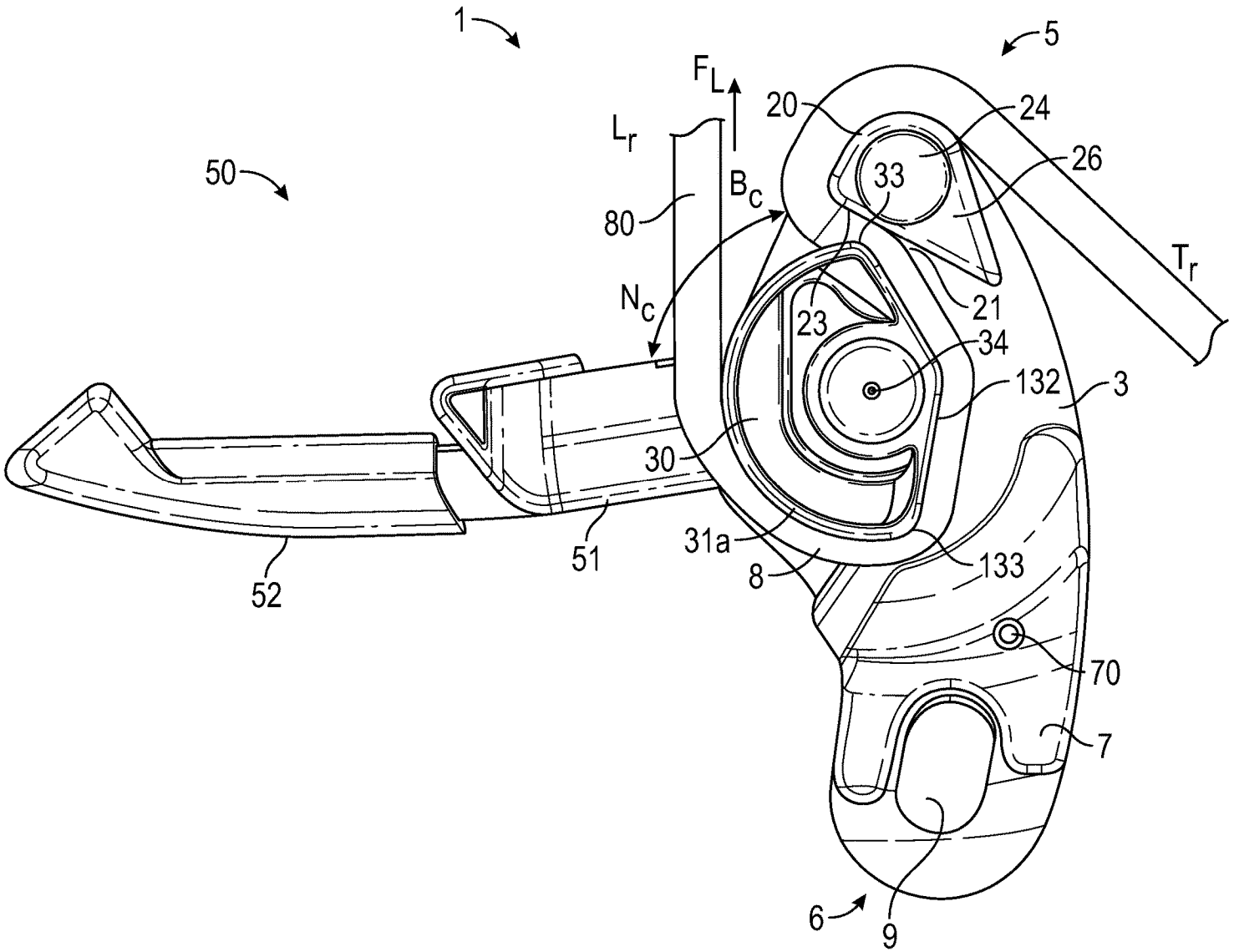
FIG. 3 is a perspective view of an exemplary fall-protection apparatus, viewed from the right side and with a right side plate omitted to show a locking cam that is in a first, braking configuration.
Figure 4:
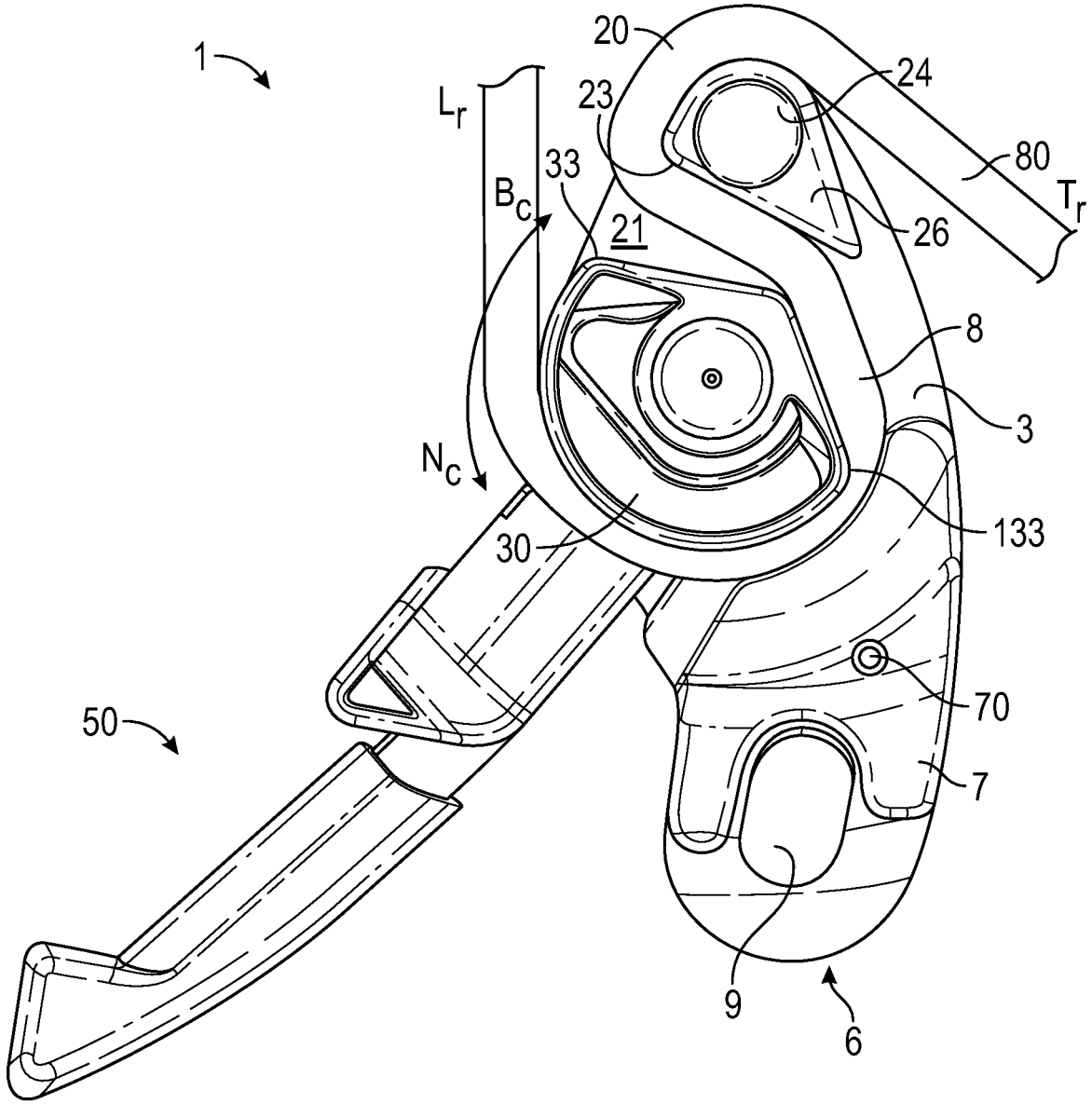
FIG. 4 is a perspective view of an exemplary fall-protection apparatus, viewed from the right side and with a right side plate omitted to show a locking cam that is in a second, non-braking configuration.
Figure 5:
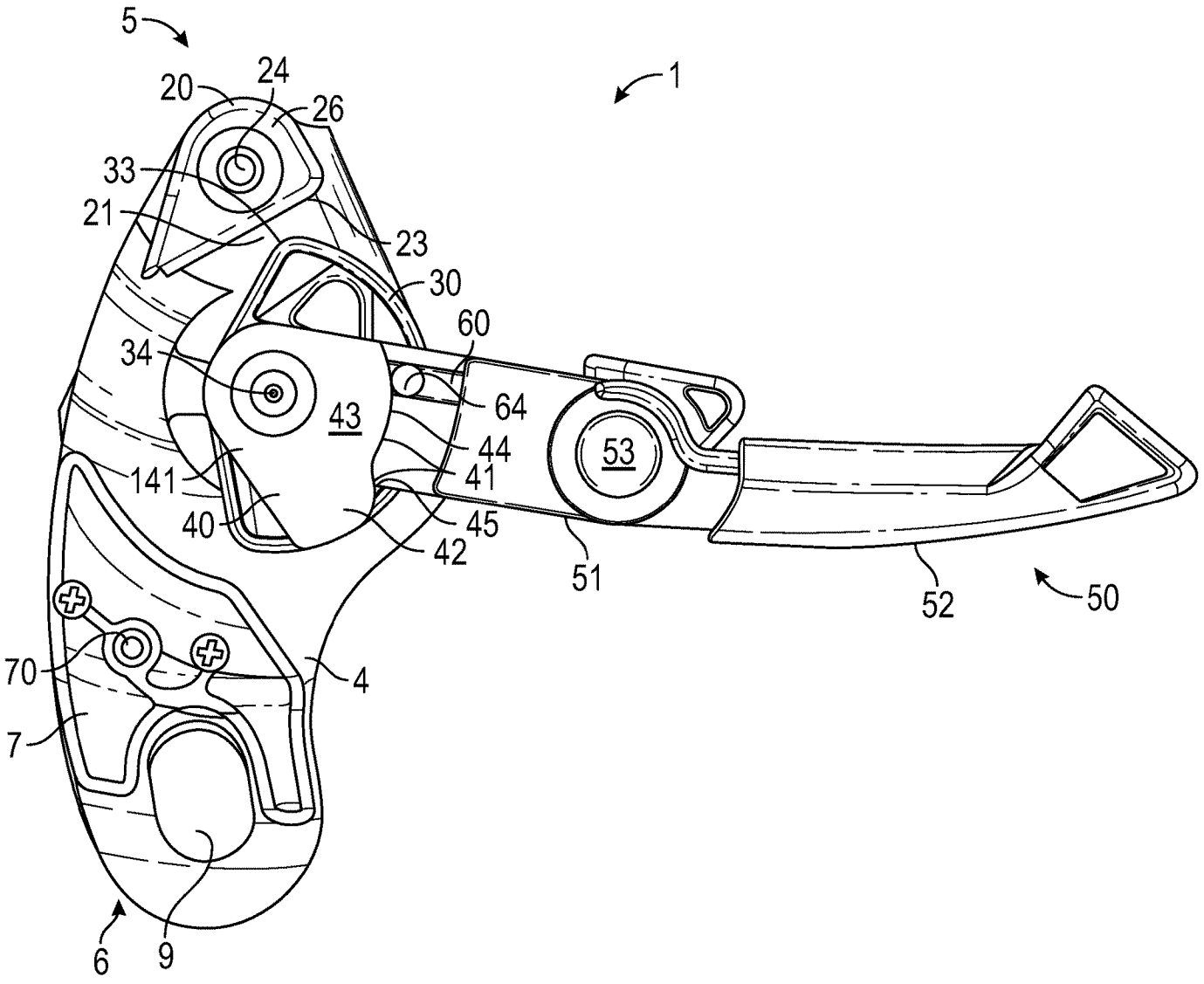
FIG. 5 is a perspective view of an exemplary fall-protection apparatus, viewed from the left side and with a left side plate omitted to show a locking cam that is in a first, braking configuration, and showing a handle that is in a first, braking position.

Handle 50 is provided for operating the braking system of apparatus 1. In the illustrated embodiment, handle 50 comprises a first (e.g. main or base) piece 51 and an extension piece 52 that is joined to main piece 51 by a hinged connection 53. Handle 50 is thus foldable to a folded position (e.g. for storage and/or carrying) as shown in FIG. 1, and can be unfolded to an extended position (e.g. as shown in FIGS. 3-5) for greater mechanical advantage when applying force to the handle. If desired, extension piece 52 can be biased (e.g. by a torsion spring) toward a folded position. Any such arrangements are optional; handle 50 can be of any suitable type, including e.g. a single-piece, non-foldable design.

With reference to FIG. 3 (which is a side view with second side plate 4 omitted for ease of presentation), apparatus 1 is configured to operate in conjunction with a rope 80 (e.g. a rope comprised of organic polymeric fibers, as distinguished from e.g. a metal cable or wire) that is seated within apparatus 1 along a serpentine path 8. In ordinary use of apparatus 1, rope 80 may comprise a load portion $L_r$ (which may extend e.g. to an attachment point of rope 80 to a support structure) and a tail portion $T_r$, which may e.g. dangle free unless grasped by a user of apparatus 1. Serpentine path 8 includes a space (gap) 21 that is located between a braking surface 23 of a braking sheave 20, and a braking surface 33 of a pivotally movable braking cam 30. These components (along with any ancillary components used therewith) collectively provide a friction braking system. Braking cam 30 can be pivotally moved between a first, braking configuration in which gap 21 is sufficiently small to pinch rope 80 therebetween (as shown in FIG. 3) to at least substantially prevent rope 80 from moving; and, a second, non-braking configuration in which gap 21 is sufficiently large to allow rope 80 to move relative to these components and thus to allow rope 80 to slidably move along serpentine path 8 (as shown in FIG. 4). With these components in a non-braking configuration, apparatus 1 and a user that is connected thereto (e.g. by a harness) will be able to move e.g. downward along rope 80, as rope 80 slidably moves through the interior of apparatus 1. With these components in a braking configuration, apparatus 1 and a user thereof will remain at least substantially stationary at a particular location along the rope.

In many embodiments braking sheave 20 may be fixedly attached to e.g. side plate 3 and/or side plate 4 so that braking sheave 20 is fixed to main body 2 and thus remains stationary with respect to main body 2 regardless of e.g. the position of handle 50 and braking cam 30. In some embodiments, braking sheave 20 may be able to deflect or move slightly (e.g. to rotate through a small arc) e.g. when rope 80 is pressed against it. However, even if braking sheave 20 is able to move slightly, it may be convenient in many embodiments that the majority of the relative movement of braking cam 30 and braking sheave 20 is performed by braking cam 30.

Braking cam 30 is able to pivot (rotate) through an arc in a first braking direction $B_c$, and in a second, non-braking direction $N_c$. The rotation of braking cam 30 may be about an axis (e.g. provided by axle 34) that is at least generally aligned with the transverse direction of apparatus 1. Movement of braking cam from the first, braking configuration of FIG. 3 to the second, non-braking configuration of FIG. 4, can be achieved by way of a user manually applying force to move handle 50 from a first, braking position as shown in FIG. 3, to a second, non-braking position as shown in FIG. 4. It will be appreciated that with apparatus 1 under a loading force $F_L$ (e.g. due to the weight of the body of a user who is connected to apparatus 1 e.g. by a harness), it may not be necessary that the user actively move handle 50 from the second, non-braking position to the first, braking position in order to place the braking system into a braking configuration. Rather, if the user ceases to actively apply downward force on handle 50 to hold it in the second, non-braking position, a loading $F_L$ on rope 80 resulting from the user's weight, will tend to pivotally move (rotate) braking cam 30 (and handle 50 along with it) back in direction $B_c$ so that cam 30 returns to its first, braking configuration and handle 50 likewise returns to its first, braking position.

In some embodiments apparatus 1 may include a biasing device (e.g. a torsion spring) that acts to urge handle 50 and/or braking cam 30 toward their second, non-braking configurations when the loading force $F_L$ is less than a particular threshold. In other embodiments, apparatus 1 will be configured so that no such biasing device or capability is present.

Figure 6:
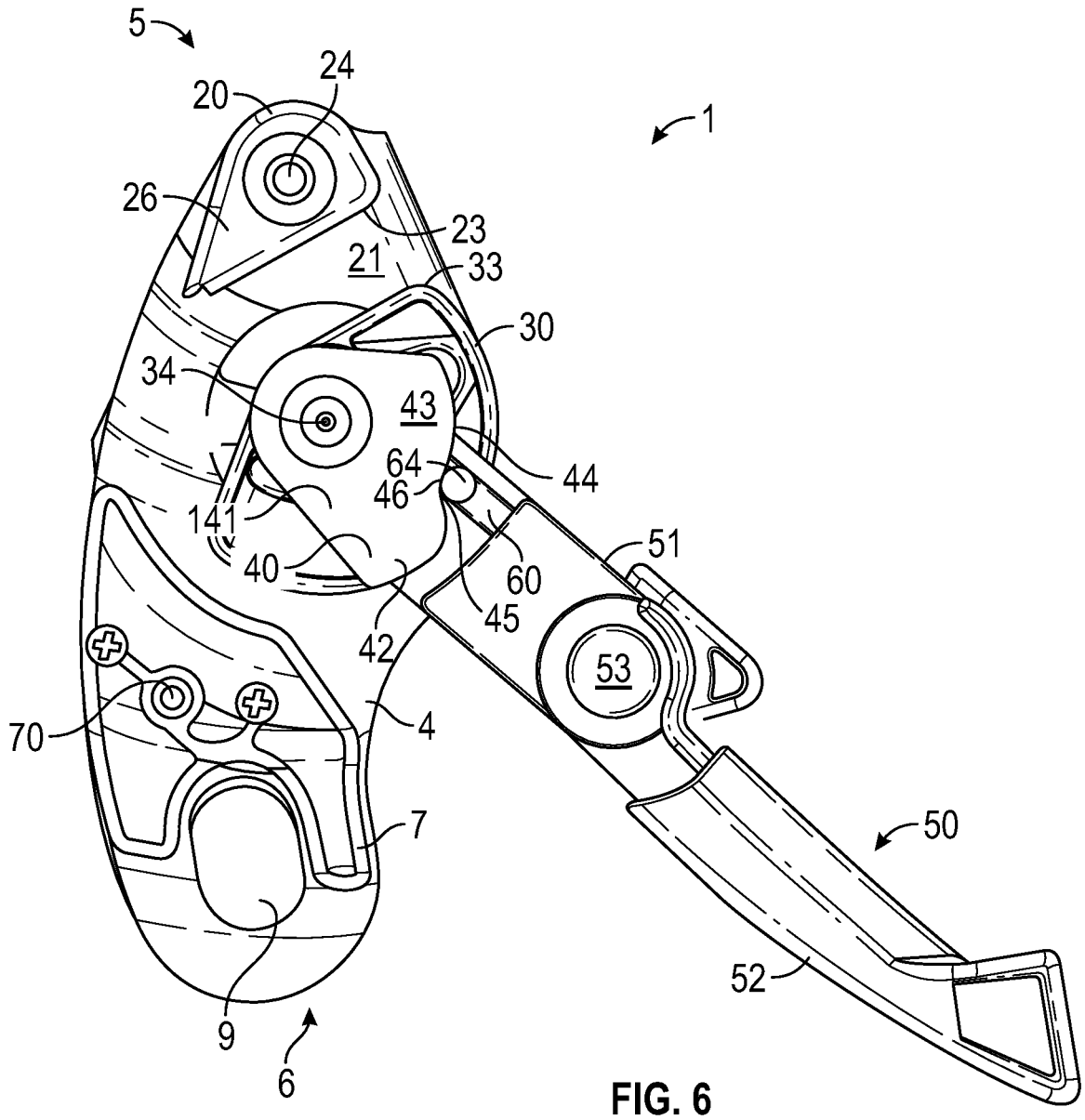
FIG. 6 is a perspective view of an exemplary fall-protection apparatus, viewed from the left side and with a left side plate omitted to show a locking cam that is in a second, non-braking configuration, and showing a handle that is in a second, non-braking position.
Figure 7:
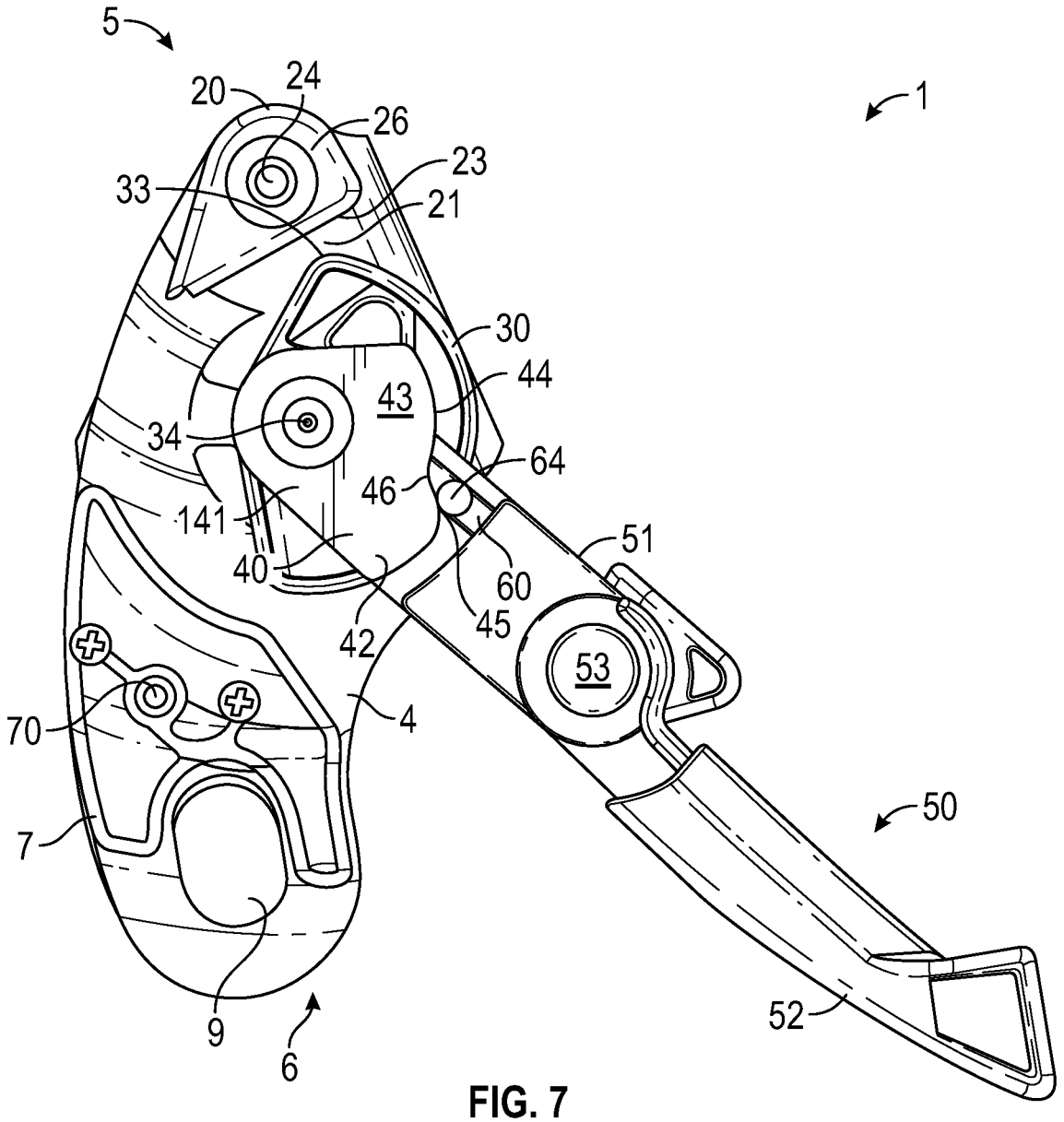
FIG. 7 is a perspective view of an exemplary fall-protection apparatus, viewed from the left side and with a left side plate omitted to show a locking cam that is in a first, braking configuration, and showing a handle that is in a third, disconnecting position.

Placing handle 50 in its first, braking position as shown in FIG. 3 thus represents a first mode of braking. However, apparatus 1 and the braking system thereof, comprises a second mode of braking, as illustrated by comparison of FIGS. 5, 6 and 7. FIGS. 5 and 6 respectively show braking cam 30 and handle 50 in the first, braking position and in the second, non-braking position, in similar manner to FIGS. 3 and 4, except viewed from the left side and with left side plate 3 and rope 80 being omitted for greater ease of viewing components of the braking system. FIG. 7 is a similar view that illustrates the functioning of apparatus 1 if handle 50 is moved further downward past the second position (of FIGS. 4 and 6), into a third, disconnecting position. When handle 50 is moved into a third, disconnecting position as shown in FIG. 7, handle 50 will be disconnected from braking cam 30 thus allowing braking cam 30 to return (e.g. as motivated by a load $F_L$ on rope 80 as described above) to the first, braking position, even though handle 50 may remain in the third position rather than returning to the first position, as is evident from inspection of FIG. 7.

A disconnectable connection between handle 50 and braking cam 30 can be achieved by way of an elongate pin 60 that is slidably seated within an elongate channel 54 that is at least partially defined by handle 50. Elongate pin 60 and channel 54 are partially visible in FIGS. 5-7 and are more fully visible in the isolated exploded views of FIGS. 8 and 9 (noting also that in the illustrated embodiment, channel 54 is defined within a main piece 51 of a two-piece handle 50). Elongate pin 60 is slidably movable along a forward (engaging)—rearward (disengaging) direction $E_p$-$D_p$ as shown in FIG. 9, between a forward position and a rearward position. Elongate pin 60 and braking cam 30 are configured so that when elongate pin 60 is in the forward position elongate pin 60 is engaged with braking cam 30 so that handle 50 is connected to braking cam 30. Elongate pin 60 and braking cam 30 are further configured so that when elongate pin 60 is in the rearward position elongate pin 60 is disengaged from braking cam 30 so that handle 50 is disconnected from braking cam 30.

The engaging of elongate pin 60 with braking cam 30 is facilitated by providing braking cam 30 with an annular bushing 35, as seen most easily in FIG. 9 (noting that FIG. 9 is an isolated view of braking cam 30 and bushing 35 thereof and of elongate pin 60 and of main portion 51 of handle 50; also, in FIG. 9 elongate pin 60 has been exploded rearward away from bushing 35 and handle portion 51 has been exploded transversely outward away from pin 60, in order that all components can be clearly seen.) Annular bushing 35 protrudes transversely outward from a main body 135 of braking cam 30; in many embodiments, annular bushing 35 may be integral with main body 135, meaning that both are part of a single-piece unit, made at the same time and made of the same material. Bushing 35 is provided with a gap 36 (e.g. a notch or cut-out) that extends transversely along a portion (e.g. a transversely-outward portion as shown in FIG. 9) of bushing 35 and that extends partially circumferentially around bushing 35, again as shown in FIG. 9. A circumferentially-facing, transversely-extending surface 37 defines a circumferential terminus of gap 36; surface 37 is a mating surface that is configured to be contacted by a thrust surface of elongate pin 60.

As shown in FIG. 9, elongate pin 60 comprises a forward section that comprises a thrust surface 63. When elongate pin 60 is in the forward position, at least a portion of thrust surface 63 of pin 60 is able to directly contact at least a portion of mating surface 37 of bushing 35. A force that is applied to handle 50 can thus be transmitted into pin 60 and from thrust surface 63 of pin 60 to mating surface 37 of bushing 35. This will provide that a downward force (in the view of FIG. 9) applied to handle 50 can cause braking cam 30 to rotate in the non-braking direction $N_c$ and/or can prevent braking cam 30 from being rotated in the braking direction $B_c$ by a load $F_L$ applied by rope 80. In this manner handle 50 and braking cam 30 can be moved into a braking configuration and can be held there in spite of a load $F_L$ that may be present on a rope 80 on which apparatus 1 is mounted.

In some embodiments forwardmost surface 62 of elongate pin 60 may be a transversely-planar, circumferentially-arcuate surface that is a different surface from thrust surface 63 of elongate pin 60, as is evident in FIG. 9. Surface 62 of pin 60 may be congruent with radially-outward-facing surface 38 of annular bushing 35, which surface 38 defines a radially inwardmost terminus of circumferentially-extending gap 36 of annular bushing 35, again as shown in FIG. 9. It will be appreciated that when elongate pin 60 is in the forward position this forwardmost surface 62 of pin 60 may be in slidable contact with radially-outward-facing surface 38 of annular bushing 35.

Figure 8:
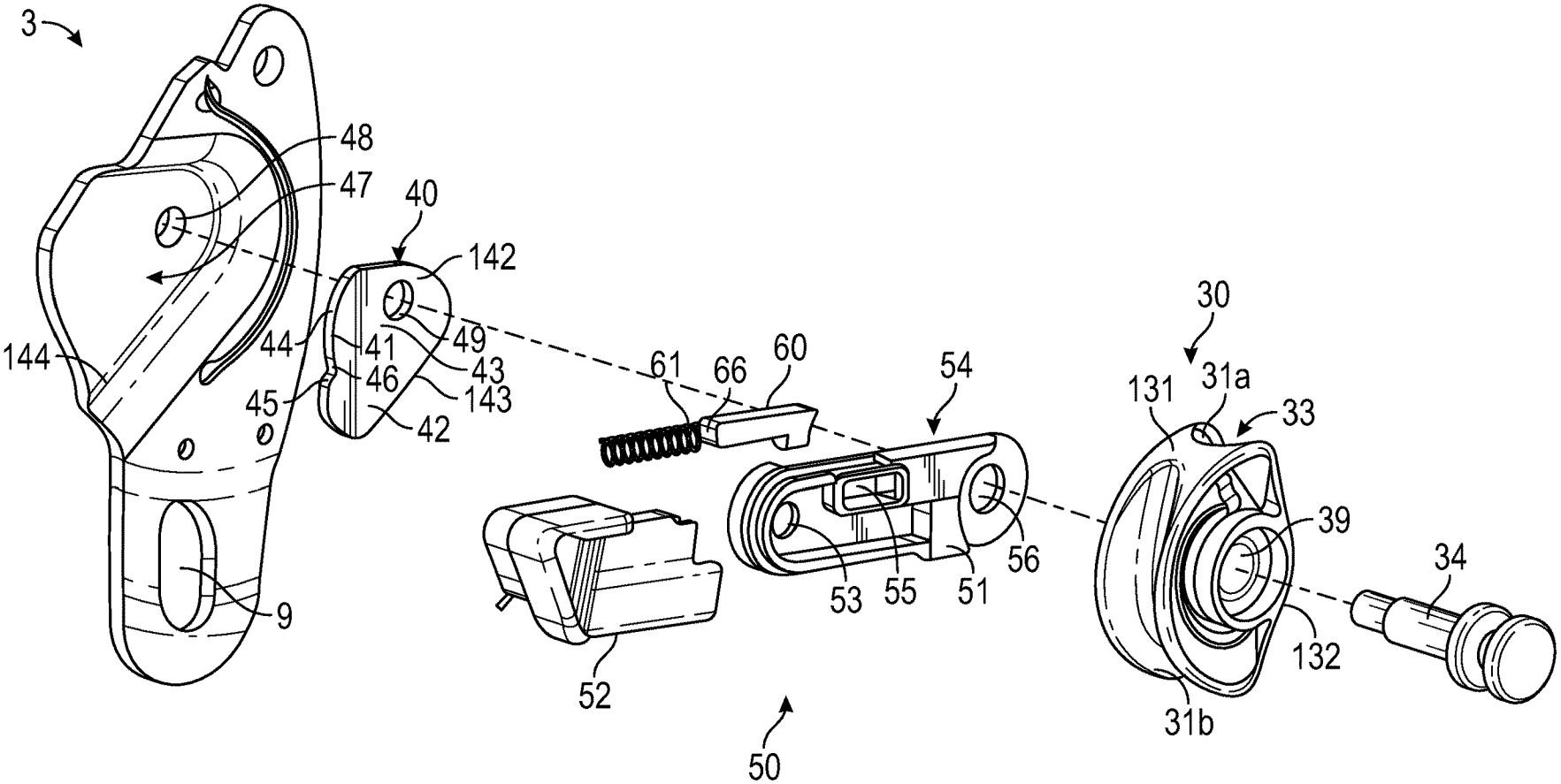
FIG. 8 is an exploded perspective view of components of an exemplary braking system.
Figure 9:
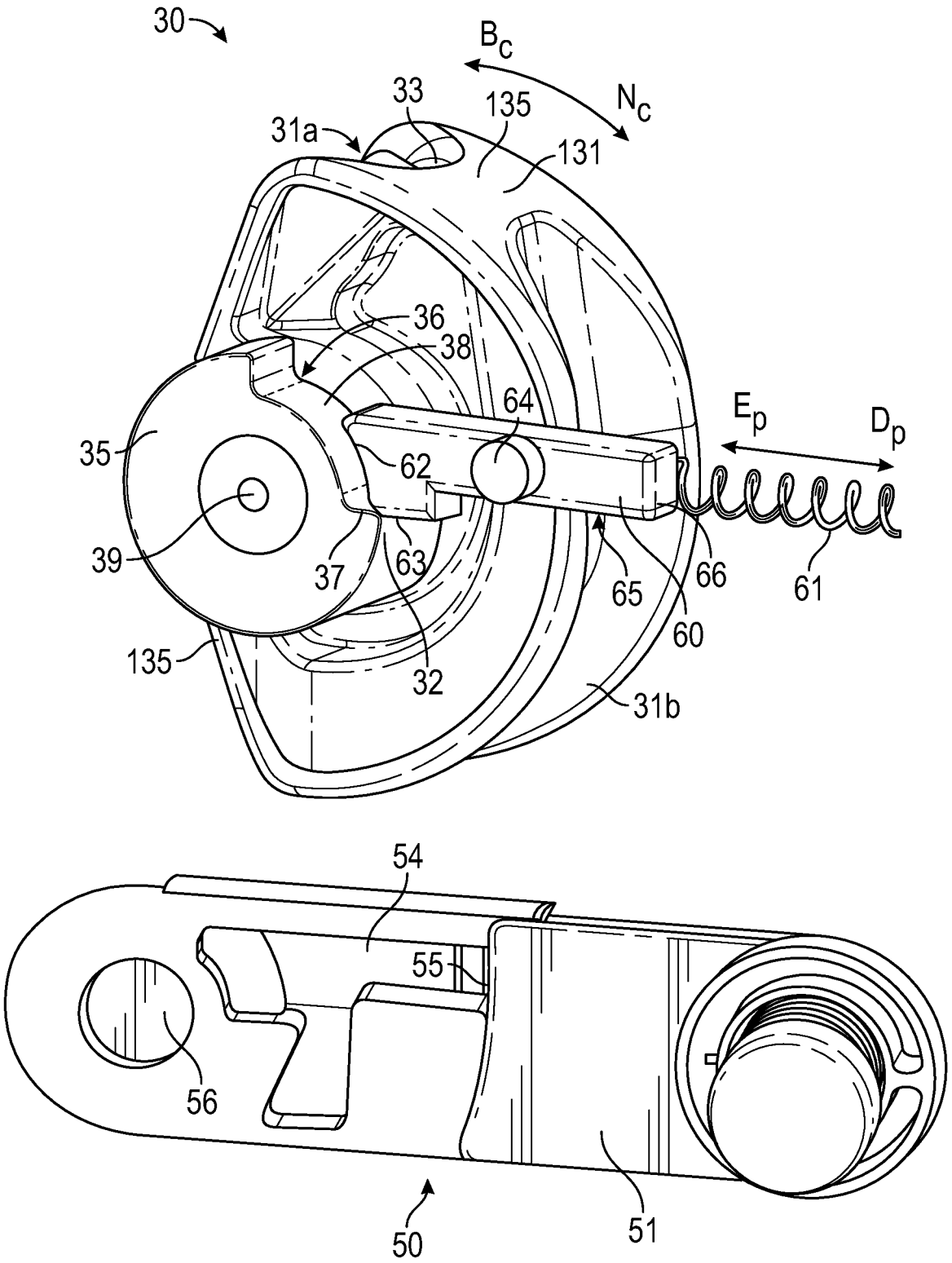
FIG. 9 is a two-axis exploded isolated perspective view of components of an exemplary braking system.

As is evident from FIGS. 8 and 9, elongate pin 60 may exhibit an identifiable long axis, which in some embodiments may be at least generally aligned with a long axis of handle 50. Elongate pin 60 is slidably movable along elongate channel 54 of handle 50 along a forward-rearward (engaging-disengaging) direction $E_p$-$D_p$, which direction, in some embodiments, may be at least generally aligned with a long axis of elongate pin 60 and/or with a long axis of handle 50. Elongate pin 60 comprises a forward end (e.g. with a forwardmost surface 62 as noted above) and a rearmost end 65 that comprises a rearmost surface 66. Elongate pin 60 also comprises a boss 64 (most easily seen in FIG. 9) that protrudes at least generally transversely from elongate pin 60 and whose purpose will be discussed in detail below.

A biasing member 61 is present that provides a biasing force that biases elongate pin 60 forward so that in the absence of any force being applied to overcome the biasing force, elongate pin will tend to be in the forward position. It will be appreciated that such a biasing member can bias elongate pin 60 so that when handle 50 is in the first, braking position elongate pin 60 is in the forward position in which pin 60 is engaged with braking cam 30; and, when handle 50 is in the second, non-braking position, elongate pin 60 is likewise in the forward position in which pin 60 is engaged with the braking cam. In some embodiments, biasing member 61 may take the form of a biasing spring that is positioned rearwardly of rearmost end 65 of elongate pin 60 and that applies a biasing force to rearmost surface 66 of pin 60, as in the exemplary design of FIG. 9. In particular embodiments, such a biasing spring may be an elongate, compression coil spring that is seated within an elongate space 55 at least partially defined by the handle, which elongate space 55 is a rearward extension of elongate channel 54 within which elongate pin 60 is slidably seated, again as shown in FIG. 9.

It will be appreciated from the above descriptions that biasing member 61 will urge elongate pin 60 toward a forward position and maintain elongate pin 60 in that forward position unless some rearward acting force is applied to elongate pin 60 that overcomes the biasing force and urges elongate pin 60 toward its rearward position. Such a force can be provided by a cam plate 40 as shown in FIGS. 5-7 and as visible in the exploded view of FIG. 8.

In some embodiments cam plate 40 may be fixed to main body 2 of apparatus 1; for example, it may be fixedly attached (directly or indirectly) to a side plate of main body 2. In some exemplary embodiments this can be achieved by mounting cam plate 40 within an open-ended cavity 47 that is defined by first side plate 3 of apparatus 1, so that upper and lower minor edges 143 of cam plate 40 are respectively abutted against upper and lower complementary flanges 144 of side plate 3. When cam plate 40 is attached to side plate 3 (e.g. by way of axle 34 that passes through axle-receiving orifice 48 of side plate 3, axle-receiving orifice 49 of cam plate 40, axle-receiving orifice 56 of handle 50, and axle-receiving orifice 39 of braking cam 30, as shown in FIG. 8), cam plate 40 will not be able to move with respect to side plate 3, as is evident from inspection of FIG. 8. Specifically, such a cam plate 40 will not be able to rotate (about an axis aligned with axle 34) relative to side plate 3. However, in other embodiments cam plate 40 may be attached to a side plate of main body 2 so as to be able to move slightly with respect to that side plate and thus to main body 2, as long as such movement does not interfere with the function of cam plate 40.

In the illustrated embodiment, cam plate 40 may exhibit first and second major sides 141 and 142, which, in some embodiments, may be at least generally flat and/or parallel to each other. While the illustrated embodiment uses a cam plate that is provided separately and is attached to side plate 3, it will be appreciated that if desired a cam plate could be provided as an integral part of side plate 3.

However provided, cam plate 40 comprises a minor edge surface 41 that is an actuating surface. Actuating surface 41 comprises two sections, a first section 44 provided by main portion 43 of cam plate 40, and a second section 45 provided by lobe portion 42 of cam plate 40, as shown in FIGS. 5-8 and as visible in isolated view in FIG. 10. (In at least some embodiments, cam plate 40 can take the form of a single, unitary piece in which lobe portion 42 protrudes integrally from main portion 43 of cam plate 40.) As noted above, elongate pin 60 comprises a boss 64 that protrudes at least generally transversely from elongate pin 60. Actuating surface 41 of cam plate 40 is configured so that transversely-protruding boss 64 can slidably move along surface 41 during movement of handle 50 between the first, second and third positions.

The interaction of cam plate 40 and elongate pin 60 that facilitates engaging and disengaging of elongate pin 60 from braking cam 30 can be understood by comparison of FIGS. 5-7. As shown in FIGS. 5 and 6, as handle 50 is moved (downward, in this view) from its first, braking position of FIG. 5, toward its second, non-braking position of FIG. 6, boss 64 of elongate pin 60 slidably traverses first section 44 of actuating surface 41. Because first section 44 is a circumferentially-extending section in which all points of first section 44 of actuating surface 41 are at least substantially equidistant from the axis of rotation of the handle, boss 64 merely travels along first section 44 of actuating surface 41 with no little or no rearward force being exerted by surface section 44 to overcome the forward biasing force exerted by biasing member 61. As handle 50 is moved further downward towards its third, disconnecting position, boss 64 of elongate pin 60 will reach junction 46 between first section 44 of actuating surface 41 and a second section 45 of actuating surface 41, and will then slidably travel along second section 45 of actuating surface 41 as shown in FIG. 7.

Second section 45 of actuating surface 41 resides on lobe portion 42 of cam plate 40 and is a circumferentially-extending section that is configured so that the distance from the axis of rotation of handle 50 to second section 45 of actuating surface 41 increases as section 45 is traversed in a direction away from junction 46. Slidable movement of boss 64 of elongate pin 60 along second section 45 of actuating surface 41 will thus cause elongate pin 60 to be urged rearward along the long axis of elongate pin 60. Biasing member 61 can be configured so that the rearward force on elongate pin 60 that is caused by the interaction of surface section 45 of cam plate 40 with boss 64 of elongate pin 60, is sufficient to overcome the forward force applied to elongate pin 60 by biasing member 61. Sufficient rearward movement of pin 60 will cause thrust surface 63 of pin 60 to break contact with mating surface 37 of bushing 35 of braking cam 30, causing pin 60 to be disengaged from bushing 35 and thus disconnecting handle 50 from braking cam 30. Braking cam 30 will thus be free to pivotally move (e.g. urged by a loading force $F_L$ on load end Lrof rope 80) in direction $B_c$ and into its first, braking configuration, without handle 50 moving to its first, braking position. (During this process forwardmost surface 62 of elongate pin may now be in slidable contact with radially outermost surface 32 of bushing 35, as is evident from FIG. 9.)

It will be appreciated that in ordinary use of apparatus 1, the disengaging of elongate pin 60 from bushing 35 of braking cam 30 is reversible. That is, if handle 50 is moved into the third, disconnecting position (whether intentionally or inadvertently) such that elongate pin 60 is disengaged from bushing 35, handle 50 may, at an appropriate time, be moved toward its first, braking position. This can allow forward end of pin 60 to re-enter the above-described gap 36 of bushing 35 so that contact of thrust surface 63 of pin 60 with mating surface 37 of bushing 35 can be re-established to place apparatus 1 in a ready-to-use condition e.g. with braking cam 30 and handle 50 each in their first, braking positions. (It will also be appreciated that when handle 50 is disconnected from braking cam 30, handle 50 still remains connected to main body 2 of apparatus 1.)

Figure 10:
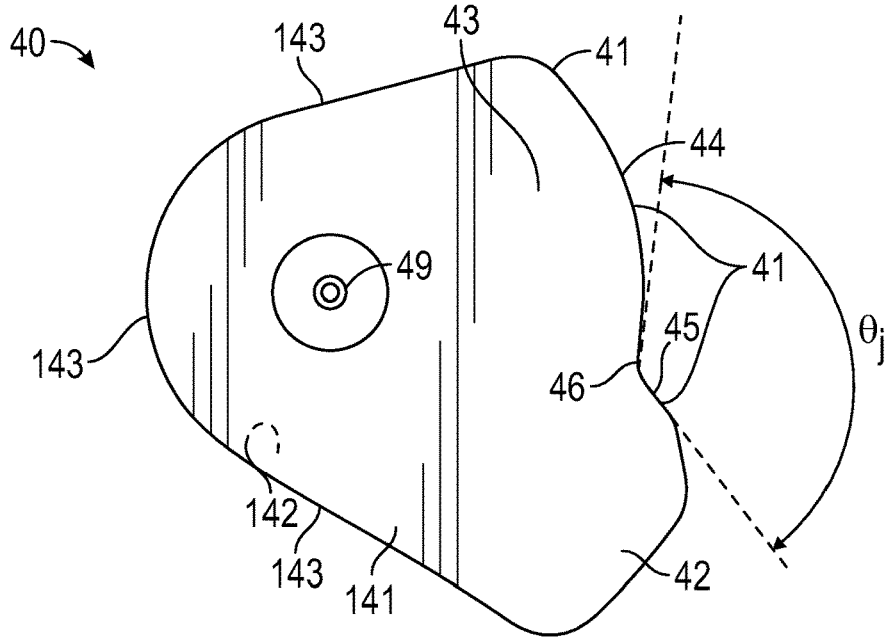
FIG. 10 is a plan view of an exemplary lobed cam plate of a braking system.

First and second sections 44 and 45 of actuating surface 41 are indicated in further detail in the isolated plan view of cam plate 40 in FIG. 10. As shown in exemplary illustration in FIG. 10, in some embodiments a junction 46 between first and second sections 44 and 45 of surface 41 can be configured so that there is a somewhat pronounced change of direction of actuating surface 41 at junction 46 (in contrast to an arrangement in which e.g. first section 44 transitions smoothly into second section 45 with very little immediate change in direction). Such an arrangement can be characterized by a junction angle $\theta_j$ between first and second sections 44 and 45 of surface 41. In various embodiments, such a junction angle may be at most about 180, 170, 160, 150, or 145 degrees (noting that a smoothly-transitioning junction would be expected to exhibit a junction angle of about 180 degrees). In further embodiments, such a junction angle may be at least about 110, 120, 130, or 140 degrees (noting that the exemplary lobed cam plate of FIG. 10 exhibits a junction angle estimated to be in the range of 140-145 degrees).

The relationship of first section 44 of actuating surface 41 to second section 45 of actuating surface 41 can also be characterized by the radius of curvature of each section. In various embodiments, the ratio of the radius of curvature of second section 45 to first section 44 may be at least about 1.0, 1.1, 1.2, 1.3, 1.4, 1.5, 1.6, 1.7, 1.8, 1.9, or 2.0. In further embodiments, the ratio of the radius of curvature of second section 45 to first section 44 may be at most about 2.15, 2.05, 1.95, 1.85, 1.75, 1.65, 1.55, 1.45, 1.35, 1.25, or 1.15. In specific embodiments the radius of curvature of first section 44 may range from about 13, 14, 15 or 16 mm, to about 21, 20, 19, or 18 mm; in further embodiments, the radius of curvature of second section 45 may range from about 18, 19, 20, or 21 mm, to about 26, 25, 24 or 23 mm. It is noted that while in many embodiments it may be advantageous that first section 44 exhibit a radius of curvature that is at least substantially uniform over the extent of first section 44, in various embodiments the radius of curvature of second section 45 may be constant, or it may change (e.g. increase or decrease) over the extent of second section 45. The center of curvature of second section 45 may also be offset from the center of curvature of first section 44. It is further noted that in various embodiments second section 45 may exhibit a convex shape (as does first section 44, e.g. as seen in FIG. 10), a concave shape, or an at least substantially linear shape. All such variations are within the scope of a lobed cam plate 40 as disclosed herein.

It is noted however that in some embodiments the presence of a somewhat pronounced change in direction at junction 46 (whether characterized e.g. by way of a junction angle and/or by a ratio of radii of curvature) can provide that a user of apparatus 1 may be able to sense at least a slight increase in resistance to further movement of handle 50 toward its third, disconnecting position, as boss 64 of elongate pin 60 reaches junction 46. This can provide sensory input to the user that handle 50 is reaching the end of its second, braking position and is about to transition into the third, disconnecting position. This may advantageously allow the user to maintain handle 50 in the second, braking position (so as to not inadvertently move it to the third, disconnecting position) without having to rely purely on e.g. visual input as to the position of the handle. (It will be appreciated from these descriptions that the first, second and third positions of handle 50 are properly considered to be ranges rather than "point" positions.)

From the discussions above it is evident how braking cam 30, braking sheave 20, handle 50, and elongate pin 60 (along with other ancillary components) can collectively provide a friction braking system with auto-locking capability such that system can perform braking even if handle 50 is (e.g. inadvertently) moved past the second, non-braking position to a third, disconnecting position. It will be appreciated that such arrangements may allow apparatus 1 to be smaller in size and/or lighter in weight, and/or less complicated to assemble, than e.g. an apparatus with an auto-locking capability provided by assemblies comprising e.g. drive fingers, ramps, pivotally-mounted transmission levers, and the like.

Braking cam 30 is designed to allow rope 80 to pass around a portion of its perimeter and to allow rope 80 to slidably move with respect to braking cam 30 when desired; and, to pinch rope 80 against braking sheave 20 when desired so that little or no movement of rope 80 with respect to braking cam 30 and braking sheave 20 can occur. In some embodiments, at least portions of the perimeter of braking cam 30 may be provided with at least one guide groove 31 that can accept rope 80 at least partially thereinto thus e g enhancing the ease with which rope 80 can be maintained at least generally transversely centered within apparatus 1. In specific embodiments, two such guide grooves 31*a* and 31*b* may be provided, separated from each other by first plano area (meaning an area without a groove, e.g. that is at least generally flat or that follows the overall curvature of the perimeter of cam 30) 131 of braking cam 30 (all such features can be most easily seen in FIGS. 8 and 9). It has been found that providing such a first guide groove 31*a* so that at least a portion of guide groove 31*a* is coincident with braking surface 33 of braking cam 30, can advantageously provide that braking surface 33 of cam 30 can combine with braking surface 23 of braking sheave 20 to pinch rope 80 therebetween with considerable force, while minimizing any tendency for rope 80 to be abraded, frayed, or otherwise deleteriously affected by the pinching/braking action.

If desired, in some embodiments the perimeter of braking cam 30 may comprise a second plano area 132 (pointed out in FIGS. 8 and 9, noting that only an edge of piano area 132 is visible in those Figures) between guide grooves 31*a* and 31*b*. It will be appreciated that a junction 133 (located e.g. as shown in FIGS. 3 and 4) between second guide groove 31*b* and second plano area 132 can advantageously enable the generation of direction-dependent frictional forces between braking cam 30 and rope 80. For example, with braking cam 30 in its second, non-braking position as shown in FIG. 4, the presence of a sufficient load force $F_L$ will tend to urge rope 80 through serpentine path 8 in the load direction $L_r$. This attempted movement of rope 80 in this direction can cause increased frictional forces to be applied to rope 80 (particularly in the neighborhood of junction 133 of braking cam 30) thus urging braking cam 30 to rotate in the $B_c$ direction toward its first, braking configuration. Conversely, lesser frictional forces may be applied to rope 80 when rope 80 is urged to move through serpentine travel path 8 in the tail direction $T_r$ (again with braking cam 30 in its second, non-braking position). This may enhance the ease with which a user can ascend along rope 80, and/or can take up slack on the load end $L_r$ of rope 80, when desired. (From these descriptions, it will be appreciated that apparatus 1 as disclosed herein, is distinguished from a fall-protection product in which a rope passes through the interior of the product in a straight line rather than following a serpentine path that passes around at least a significant portion of a perimeter of a braking cam.)

As noted above, in many embodiments apparatus 1 may include a main body 2 that comprises a first side plate 3 and a second side plate 4 (along with other ancillary components as are found useful). In some embodiments, a second side plate 4 may be pivotally connected to a first side plate 3 so that the second side plate can be pivotally moved relative to the first side plate between a first, open position in which a rope can be inserted into the apparatus (i.e., threaded into serpentine path 8) and a second, closed position in which apparatus 1 is ready for use. It will be appreciated that all descriptions above of operation of apparatus 1, apply to apparatus 1 in a closed, ready-to-use configuration, and that all Figures herein show apparatus 1 in a closed, ready-to-use configuration. It will be further understood that by a component of apparatus 1 being described as "fixed to" the main body of the apparatus, is meant that the component is fixedly attached to at least one side plate of the main body of the apparatus so that the component cannot move (e.g. rotate) relative to the side plate, and hence cannot move (e.g. rotate) relative to either side plate when the side plates are in their closed, ready-to-use position.

In some embodiments, a second side plate 4 may be pivotably movable relative to a first side plate 3 around an axle 24 that is connected to both side plates and that extends at least generally transversely through apparatus 1 and that passes through an interior space 26 defined by braking sheave 20, as shown in exemplary illustration in FIGS. 1-3. (In such an arrangement, braking sheave 20 may be fixedly attached to first side plate 3.) In some embodiments at least one locking mechanism (e.g. a locking pin 70 that can be pushed transversely in order to unlock side plate 4 from spacer strut 7, which spacer strut is itself fixedly attached to first side plate 3) can be included by which second side plate 4 can be unlocked in order to open apparatus 1 to insert a rope therein. As is evident in FIG. 11, in some embodiments second side plate 4 may comprise an open-ended slot 73 that allows passage of a terminal end of axle 34 therethrough as side plate 4 is moved to the open position. (When side plate 4 is in the second, closed position, this terminal end of axle 34 will be supported within open-ended slot 73.) In such embodiments an opposing terminal end of axle 34 may be seated in an orifice 48 of first side plate 3 (visible in FIG. 8), which orifice 48 is not an open-ended slot in the manner of slot 73. Axle 34 will thus remain attached to first side plate 3 even when the side plates are moved into their open configuration for insertion of a rope. In some embodiments, a terminal end of axle 34 may be seated in orifice 48 and fixedly attached to side plate 3 (for example, a terminal end of axle 34 may be riveted in place in orifice 48). Axle 34 may also pass through aligned axle-seating orifices 39, 56 and 49 of braking cam 30, handle 50 and cam plate 40, as shown in FIG. 8. It will be appreciated that axle 34 upon which the braking cam, handle, and cam plate are mounted is separate from axle 24 that can e.g. pass through interior space 26 of braking sheave 20 and about which side plate 4 can be rotated relative to side plate 3 to open apparatus 1 to insert a rope therein.

In some embodiments, a lower end 6 of main body 2 of apparatus 1 may comprise at least one orifice 9 configured to receive a portion of an attachment device (e.g., a carabiner or D-ring) so that the attachment device is secured to lower end 6 of apparatus 1 (and can e.g. be used to attach apparatus 1 to a harness or belt of a user). In many embodiments orifice 9 may be provided by aligned orifices of side plates 3 and 4. In some embodiments (e.g. as depicted in FIGS. 1-3) the aligned orifices of side plates 3 and 4 that collectively provide orifice 9 of apparatus 1 may both be bounded orifices. This can provide that a portion of an attachment device that is received into orifice 9 physically blocks movement of second side plate 4 relative to first side plate 3 so that second side plate 4 cannot be pivotally moved to the first, open position if an attachment device is secured to lower end 6 of apparatus 1.

Figure 11:
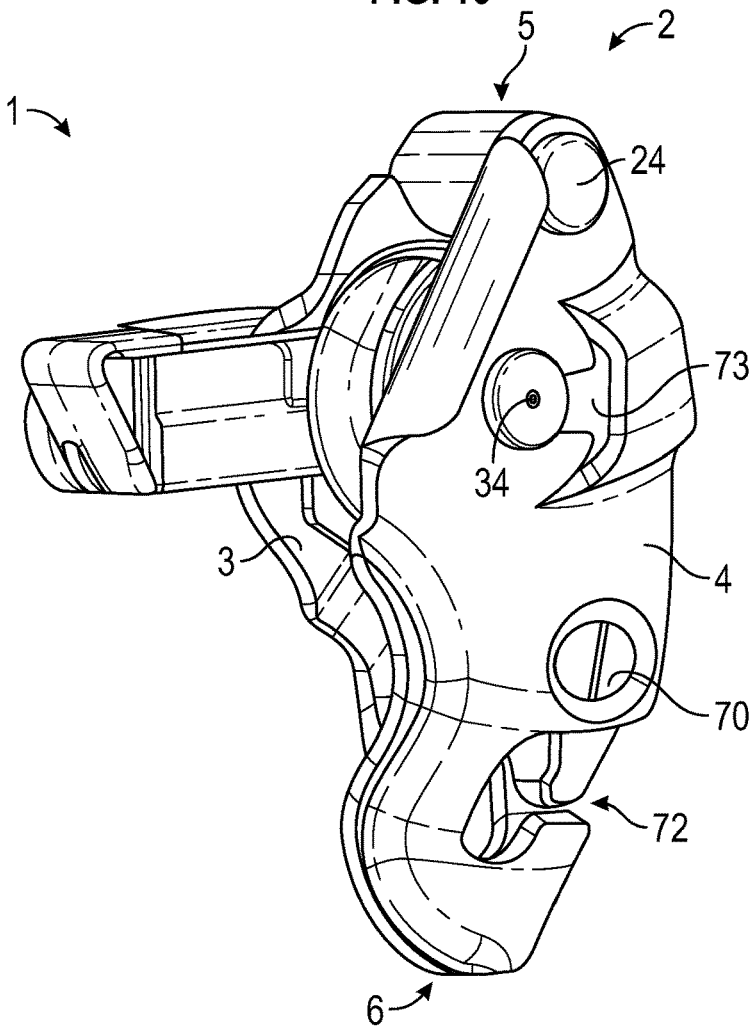
FIG. 11 is a perspective view, from the right side, of another exemplary fall-protection apparatus.

An alternative arrangement is shown in exemplary embodiment in FIG. 11, in which orifice 9 is provided by a (bounded) orifice of side plate 3 in alignment with an aperture in side plate 4 that takes the form of an open-ended slot rather than a bounded orifice. It will be appreciated that with such an arrangement second side plate 4 can be pivotally moved relative to first side plate 3 to the first, open position even when an attachment device is secured to lower end 6 of apparatus 1. That is, the presence of a portion of an attachment device within orifice 9 will not physically block the movement of side plate 4 to the first, open position. (It will be noted that the exemplary apparatus of FIG. 11 includes a locking mechanism 70 that differs somewhat from the locking mechanism of FIG. 1.)

In various embodiments, certain components of apparatus 1, including e g but not limited to first and second side plates 3 and 4 of a main body of apparatus 1, braking sheave 20, braking cam 30 and e.g. a bushing 35 thereof, elongate pin 60, axles 24 and/or 34, and/or at least a main portion 51 of handle 50, may be made of any suitable metal. (Particular components, e.g. side plates 3 and 4, may be made of aluminum; other components, e.g. cam plate 40, may be made of steel e.g. to provide enhanced wear resistance.) In various embodiments, other components (e.g. an ornamental shroud that may surround a portion of apparatus 1, a gripping surface of e.g. extension piece 52 of handle 50, etc.) may be made of some other material, e.g. molded plastic or rubber. It will be understood that various ancillary components such as e.g. washers, nuts, screws, bolts, rivets, spacers, gaskets, and so on, may be conveniently incorporated into apparatus 1. While not identified by number in any of the Figures or discussed in specific detail herein, it will be understood that any such components (whether made of metal, molded plastic such as e.g. polyamide or poly(tetrafluoroethylene), or other material) may be present in apparatus 1 as desired, in accordance with the background knowledge of one skilled in the art of designing fall-protection apparatus. In some embodiments one or more components of apparatus 1 may comprise a feature or features that provide one or more physical stops to limit the maximum range of movement of handle 50. (It will be apparent e.g. from FIGS. 1 and 8 that side plate 3 as depicted therein has features that serve this function).

In various embodiments, apparatus 1 may be used in any fall-protection application, for example in products, appliances and/or systems commonly referred to as rope adjusters, descenders, work-positioning systems, work-positioning lanyards, and so on. Apparatus 1 thus may find use in e.g. at-height construction, rescue operations, and so on, and if desired may be used in the presence of any desired type of fall-arrest system (such as e.g. a self-retracting lifeline). In brief, a user may apply force to move handle 50 from its first, braking position to its second, non-braking system e.g. in order to controllably descend along a rope. A user may ascend upward without necessarily having to apply force to move handle 50 from its first, braking position to its second, no-braking position. Rather, a user may user apply a pulling force to tail end $T_r$ of the rope (e.g. while grasping the load end $L_r$ of the rope to take at least a portion of the user's weight), which may cause braking cam 30 to move away from its braking configuration (and may thus move handle 50 away from its braking position as well). The user may then move upward (e.g. assisted by a force applied by the user's legs to an adjacent structure), as will be well understood by the ordinary artisan. Ordinary artisans will appreciate that in some uses rope 80 may not extend strictly vertically upward from the user to an attachment point; it will be understood that all descriptions of uses provided herein are for purposes of illustration and do not imply that apparatus 1 can only be used with a rope 80 that is in a purely vertical configuration.

Apparatus 1 may be used with any suitable rope 80, which rope may comprise a diameter (e.g. one-half inch) that is compatible with operation of apparatus 1, and may be comprised of a twisted or braided arrangement of multiple strands. Rope 80 will be comprised of one or more organic polymeric materials and as such is distinguished from e.g. metal cables and the like. In various embodiments, rope 80 may be comprised of any suitable polyamides, aromatic polyamides (aramids), or polyesters. Suitable ropes may be include e.g. aramid fiber ropes of the general type available from Teijin Aramid, Ltd. (Arnhem, Netherlands), under the trade designation TECHNORA.

In some embodiments apparatus 1 may be used with a so-called single-mode positioning system in which an end of rope 80 is attached to a support structure located e.g. at least somewhat vertically above the user. In other embodiments apparatus 1 may be used with a so-called double-mode positioning system e.g. in which apparatus 1 is attached (e.g. by a carabiner) to a first attachment point of a harness or belt of a user. Rope 80 may then be passed around a suitable structure (e.g. a post or girder) with the other, opposite end of rope 80 being attached to a second attachment point of a user's harness. Any such uses or variations thereof are possible. In some embodiments, apparatus 1 may be configured to be used in a system that meets the requirements of any or all of standards ANSI Z359.3 and EN358. In some embodiments, apparatus 1 may be configured to be used in a system that meets the requirements of any or all of standards ANSI Z359.4, EN 12481, EN 341, AS/NZS 4488 and NFPA 1983.

In some embodiments, apparatus 1 may be sold alone; in other embodiments, it may be sold as a kit which may include any of e.g. one or more ropes (which may be preloaded into apparatus 1, or may be separate from apparatus 1 but packaged in the same kit), attachment devices such as carabiners or D-rings, hooks or snaphooks, and so on. Such a kit may also include directions for use, whether physical (e.g. printed on paper) or virtual (e.g. by way of a listed website). In some embodiments, one or more surface of side plates 3 and/or 4 may comprise indicia thereon (whether embossed into the surface of the plate, printed thereon, present on a label that is adhered to the surface of the plate, and so on). Such indicia may include e.g. instructions (whether pictorial and/or text-based) on how to unlock/lock apparatus 1, how to move apparatus 1 between open and closed positions, and so on.

LIST OF EXEMPLARY EMBODIMENTS

Embodiment 1 is a fall-protection apparatus, comprising: a main body comprising a friction-braking system comprising a pivotally movable braking cam and a braking sheave that define a space therebetween that can accommodate a rope; the friction-braking system further comprising a handle that is disconnectably connected to the braking cam so that when the handle is moved from a first, braking position to a second, non-braking position the braking cam is pivotally moved from a first, braking configuration to a second, non-braking configuration, and so that when the handle is moved to a third, disconnecting position the connection between the handle and the braking cam is disconnected; wherein the disconnectable connection between the handle and the braking cam comprises: an elongate pin that is slidably seated within an elongate channel that is at least partially defined by the handle, the elongate pin being slidably movable between a forward position and a rearward position and being configured so that when the elongate pin is in the forward position the elongate pin is engaged with the braking cam and when the elongate pin is in the rearward position the elongate pin is disengaged from the braking cam; a biasing member that biases the elongate pin forward towards the forward position; and a cam plate that is attached to the main body of the apparatus and that comprises an actuating surface along which a transversely-protruding boss of the elongate pin can slidably move during movement of the handle between the first, second, and third positions, wherein the cam plate comprises a lobe portion that is configured so that as the handle is moved to its third, disconnecting position, slidable movement of the boss of the elongate pin along the actuating surface of the lobe portion of the cam plate causes the elongate pin to be urged into the rearward position.

Embodiment 2 is the apparatus of embodiment 1 wherein a forward section of the elongate pin comprises a thrust surface that, when the elongate pin is in its forward, engaged position, is in contact with a mating surface of the braking cam.

Embodiment 3 is the apparatus of embodiment 2 wherein the mating surface of the braking cam is an at least generally circumferentially-facing, transversely-extending surface that defines a circumferential terminus of a circumferentially-extending gap that is present in an annular bushing of the braking cam, which annular bushing is integral with a main body of the braking cam and protrudes transversely outward from the main body of the braking cam.

Embodiment 4 is the apparatus of embodiment 3 wherein the elongate pin comprises a forwardmost surface that is a transversely-planar, circumferentially-arcuate surface that is a different surface from the thrust surface of the elongate pin, and that is congruent with a radially-outward-facing surface of the annular bushing that defines a radially inwardmost terminus of the circumferentially-extending gap of the annular bushing.

Embodiment 5 is the apparatus of embodiment 4 wherein when the elongate pin is in the forward position the forwardmost surface of the elongate pin is in slidable contact with the radially-outward-facing surface of the annular bushing that defines a radially inwardmost terminus of the circumferentially-extending gap of the annular bushing.

Embodiment 6 is the apparatus of any of embodiments 1-5 wherein a long axis of the elongate pin is at least generally aligned with a long axis of the handle and wherein the elongate pin is slidably movable along the elongate channel of the handle along a forward-rearward direction that is at least generally aligned with the long axis of the elongate pin.

Embodiment 7 is the apparatus of any of embodiments 1-6 wherein the biasing member is a biasing spring that is positioned rearwardly of a rear end of the elongate pin and that applies a biasing force to a rearmost surface of the elongate pin.

Embodiment 8 is the apparatus of any of embodiments 1-7 wherein the biasing member is an elongate, coil compression spring that is seated within an elongate space at least partially defined by the handle, which elongate space is a rearward extension of the elongate channel within which the elongate pin is slidably seated.

Embodiment 9 is the apparatus of any of embodiments 1-8 wherein the biasing member provides a biasing force that biases the elongate pin forward so that when the handle is in the first, braking position the elongate pin is in the forward position in which the elongate pin is engaged with the braking cam; and when the handle is in the second, non-braking position, the elongate pin is in the forward position in which the elongate pin is engaged with the braking cam.

Embodiment 10 is the apparatus of embodiment 9 wherein when the handle is in the third, disconnecting position, a rearward force transmitted from the actuating surface of the lobe portion of the cam plate to the transversely-protruding boss of the elongate pin overcomes the forward biasing force provided by the biasing member and urges the elongate pin rearward into the rearward, disengaged position.

Embodiment 11 is the apparatus of any of embodiments 1-10 wherein the cam plate is fixed to the main body of the apparatus, wherein the lobe portion of the cam plate protrudes integrally from a main portion of the cam plate, and further wherein the main portion of the cam plate comprises a first circumferentially-extending section of the actuating surface of the cam plate, which first section is configured so that all points of the actuating surface along the first section are equidistant from an axis of rotation of the handle; and, the lobe portion of the cam plate comprises a second circumferentially-extending section of the actuating surface of the cam plate, which second section is configured so that a distance from the axis of rotation of the handle to the actuating surface of the second section increases along the second section of the actuating surface of the cam plate, in a direction away from a junction of the second section of the actuating surface with the first section of the actuating surface.

Embodiment 12 is the apparatus of embodiment 11 wherein at the junction between the second section of the actuating surface of the cam plate and the first section of the actuating surface of the cam plate, a junction angle between the second section of the actuating surface and the first section of the actuating surface is in a range of from about 160 degrees to about 120 degrees.

Embodiment 13 is the apparatus of any of embodiments 11-12 wherein a ratio of a radius of curvature of the second section of the actuating surface of the cam plate and the first section of the actuating surface of the cam plate is in a range of from about 1.1 to about 1.5.

Embodiment 14 is the apparatus of any of embodiments 1-13 wherein the braking cam, the handle, and the cam plate each comprise a transversely-oriented, axle-receiving orifice; wherein the axle-receiving orifices of the braking cam, the handle, and the cam plate are all aligned with each other; and, wherein a single, transversely-extending axle of the apparatus passes through the aligned orifices of the braking cam, handle, and cam plate.

Embodiment 15 is the apparatus of any of embodiments 1-14 wherein the braking sheave is fixed to the main body of the apparatus; wherein when the braking cam is in its first, braking configuration, a braking surface of the braking cam is located at a first distance from a braking surface of the braking sheave; and, wherein when the braking cam is in its second, non-braking configuration, the braking surface of the braking cam is located at a second distance from the braking surface of the braking sheave, which second distance is larger than the first distance.

Embodiment 16 is the apparatus of embodiment 15 wherein the braking cam comprises a first guide groove at least a portion of which is coincident with the braking surface of the braking cam, and further comprises a second guide groove, the first guide groove being separated from the second guide groove at one end of the first guide groove by a first plano area of the braking cam and being separated from the second guide groove at an opposite end of the first guide groove by a second piano area of the braking cam.

Embodiment 17 is the apparatus of any of embodiments 1-16 further comprising a rope, an elongate portion of which is received within the main body of the apparatus along a serpentine path which includes the space between the braking cam and the fixed braking sheave.

Embodiment 18 is a kit comprising the apparatus of any of embodiments 1-17 and at least one rope and instructions for use of the apparatus.

Embodiment 19 is the apparatus of any of embodiments 1-17 wherein the main body of the apparatus comprises a first side plate and a second side plate, the second side plate being pivotally connected to the first side plate so that the second side plate can be pivotally moved relative to the first side plate, between a first, open position in which a rope can be inserted into the apparatus, and a second, closed position, and further wherein the apparatus includes at least one locking mechanism whereby the second side plate can be locked in the second, closed position.

Embodiment 20 is the apparatus of embodiment 19 wherein the second side plate is pivotably movable relative to the first side plate around an axis of rotation that extends transversely through the apparatus and that passes through an interior space defined by the fixed braking sheave, and wherein the fixed braking sheave is fixedly attached to the first side plate.

Embodiment 21 is the apparatus of any of embodiments 1-17 and 19-20 wherein a lower end of the main body of the apparatus comprises an orifice configured to receive a portion of an attachment device so that the attachment device is secured to the lower end of the main body of the apparatus.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document that is incorporated by reference herein, this specification as written will control.

What is claimed is:

1. A fall-protection apparatus, comprising:

a main body comprising a friction-braking system comprising a pivotally movable braking cam and a braking sheave that define a space therebetween that can accommodate at least one rope;

the friction-braking system further comprising a handle, said handle includes a disconnectable connection to the braking cam so that when the handle is moved from a first, braking position to a second, non-braking position the braking cam is pivotally moved from a first, braking configuration to a second, non-braking configuration, and so that when the handle is moved to a third, disconnecting position the connection between the handle and the braking cam is disconnected;

wherein the disconnectable connection between the handle and the braking cam comprises:

an elongate pin that is slidably seated within an elongate channel that is at least partially defined within the handle, the elongate pin being slidably movable between a forward position and a rearward position and being configured so that when the elongate pin is in the forward position the elongate pin is engaged with the braking cam and when the elongate pin is in the rearward position the elongate pin is disengaged from the braking cam;

a biasing member that biases the elongate pin forward towards the forward position; and a cam plate that is attached to the main body of the apparatus and that comprises an actuating surface along which a transversely-protruding boss of the elongate pin can slidably move during movement of the handle between the first, second, and third positions, wherein the cam plate comprises a lobe portion that is configured so that as the handle is moved to its third, disconnecting position, slidable movement of the boss of the elongate pin along the actuating surface of the lobe portion of the cam plate causes the elongate pin to be urged into the rearward position.

2. The apparatus of claim 1 wherein a forward section of the elongate pin comprises a thrust surface that, when the elongate pin is in its forward, engaged position, is in contact with a mating surface of the braking cam.

3. The apparatus of claim 2 wherein the mating surface of the braking cam is an at least generally circumferentially-facing, transversely-extending surface that defines a circumferential terminus of a circumferentially-extending gap that is present in an annular bushing of the braking cam, which annular bushing is integral with a main body of the braking cam and protrudes transversely outward from the main body of the braking cam.

4. The apparatus of claim 3 wherein the elongate pin comprises a forwardmost surface that is a transversely-planar, circumferentially-arcuate surface that is a different surface from the thrust surface of the elongate pin, and that is congruent with a radially-outward-facing surface of the annular bushing that defines a radially inwardmost terminus of the circumferentially-extending gap of the annular bushing.

5. The apparatus of claim 4 wherein when the elongate pin is in the forward position the forwardmost surface of the elongate pin is in slidable contact with the radially-outward-facing surface of the annular bushing that defines a radially inwardmost terminus of the circumferentially-extending gap of the annular bushing.

6. The apparatus of claim 1 wherein a long axis of the elongate pin is at least generally aligned with a long axis of the handle and wherein the elongate pin is slidably movable along the elongate channel of the handle along a forward-rearward direction that is at least generally aligned with the long axis of the elongate pin.

7. The apparatus of claim 1 wherein the biasing member is a biasing spring that is positioned rearwardly of a rear end of the elongate pin and that applies a biasing force to a rearmost surface of the elongate pin.

8. The apparatus of claim 7 wherein the biasing spring is an elongate, coil compression spring that is seated within an elongate space at least partially defined by the handle, which elongate space is a rearward extension of the elongate channel within which the elongate pin is slidably seated.

9. The apparatus of claim 1 wherein the biasing member provides a biasing force that biases the elongate pin forward so that when the handle is in the first, braking position the elongate pin is in the forward position in which the elongate pin is engaged with the braking cam; and when the handle is in the second, non-braking position, the elongate pin is in the forward position in which the elongate pin is engaged with the braking cam.

10. The apparatus of claim 9 wherein when the handle is in the third, disconnecting position, a rearward force transmitted from the actuating surface of the lobe portion of the cam plate to the transversely-protruding boss of the elongate pin overcomes the forward biasing force provided by the biasing member and urges the elongate pin rearward into the rearward, disengaged position.

11. The apparatus of claim 1 wherein the cam plate is fixed to the main body of the apparatus, wherein the lobe portion of the cam plate protrudes integrally from a main portion of the cam plate, and further wherein:

the main portion of the cam plate comprises a first circumferentially-extending section of the actuating surface of the cam plate, which first section is configured so that all points of the actuating surface along the first section are equidistant from an axis of rotation of the handle; and, the lobe portion of the cam plate comprises a second circumferentially-extending section of the actuating surface of the cam plate, which second section is configured so that a distance from the axis of rotation of the handle to the actuating surface of the second section increases along the second section of the actuating surface of the cam plate, in a direction away from a junction of the second section of the actuating surface with the first section of the actuating surface.

12. The apparatus of claim 11 wherein at the junction between the second section of the actuating surface of the cam plate and the first section of the actuating surface of the cam plate, a junction angle between the second section of the actuating surface and the first section of the actuating surface is in a range of from about 160 degrees to about 120 degrees.

13. The apparatus of claim 11 wherein a ratio of a radius of curvature of the second section of the actuating surface of the cam plate and the first section of the actuating surface of the cam plate is in a range of from about 1.1 to about 1.5.

14. The apparatus of claim 1 wherein the braking cam, the handle, and the cam plate each comprise a transversely-oriented, axle-receiving orifice; wherein the axle-receiving orifices of the braking cam, the handle, and the cam plate are all aligned with each other; and, wherein a single, transversely-extending axle of the apparatus passes through the aligned orifices of the braking cam, handle, and cam plate.

15. The apparatus of claim 1 wherein the braking sheave is fixed to the main body of the apparatus; wherein when the braking cam is in its first, braking configuration, a braking surface of the braking cam is located at a first distance from a braking surface of the braking sheave; and, wherein when the braking cam is in its second, non-braking configuration, the braking surface of the braking cam is located at a second distance from the braking surface of the braking sheave, which second distance is larger than the first distance.

16. The apparatus of claim 15 wherein the braking cam comprises a first guide groove at least a portion of which is coincident with the braking surface of the braking cam, and further comprises a second guide groove, the first guide groove being separated from the second guide groove at one end of the first guide groove by a first plano area of the braking cam and being separated from the second guide groove at an opposite end of the first guide groove by a second piano area of the braking cam.

17. The apparatus of claim 1 further comprising a rope, an elongate portion of which is received within the main body of the apparatus along a serpentine path which includes the space between the braking cam and the fixed braking sheave.

18. The apparatus of claim 1 wherein the main body of the apparatus comprises a first side plate and a second side plate, the second side plate being pivotally connected to the first side plate so that the second side plate can be pivotally moved relative to the first side plate, between a first, open position in which a rope can be inserted into the apparatus, and a second, closed position, and further wherein the apparatus includes at least one locking mechanism whereby the second side plate can be locked in the second, closed position.

19. The apparatus of claim 18 wherein the second side plate is pivotably movable relative to the first side plate around an axis of rotation that extends transversely through the apparatus and that passes through an interior space defined by the fixed braking sheave, and wherein the fixed braking sheave is fixedly attached to the first side plate.

20. The apparatus of claim 1 wherein a lower end of the main body of the apparatus comprises an orifice configured to receive a portion of an attachment device so that the attachment device is secured to the lower end of the main body of the apparatus.

21. A kit comprising the apparatus of claim 1 and the at least one rope and instructions for use of the apparatus.

* * * * *